US009696022B2

(12) United States Patent
Mandy et al.

(10) Patent No.: US 9,696,022 B2
(45) Date of Patent: Jul. 4, 2017

(54) DOWNWARD ILLUMINATION ASSEMBLY

(71) Applicant: Man-D-Tec, Inc., Scottsdale, AZ (US)

(72) Inventors: Dalton J. Mandy, Scottsdale, AZ (US); Terry R. Mandy, Paradise Valley, AZ (US); Brandon R. Mandy, Scottsdale, AZ (US)

(73) Assignee: Mandy Holdings LLLP, Scottsdale, AZ (US)

( * ) Notice: Subject to any disclaimer, the term of this patent is extended or adjusted under 35 U.S.C. 154(b) by 309 days.

(21) Appl. No.: 14/209,474

(22) Filed: Mar. 13, 2014

(65) Prior Publication Data

US 2014/0268829 A1 Sep. 18, 2014

Related U.S. Application Data

(60) Provisional application No. 61/782,052, filed on Mar. 14, 2013.

(51) Int. Cl.

| | |
|---|---|
| ***F21V 15/00*** | (2015.01) |
| ***F21V 23/02*** | (2006.01) |
| ***F21S 8/02*** | (2006.01) |
| *F21Y 101/00* | (2016.01) |

(52) U.S. Cl.

CPC ..... *F21V 23/023* (2013.01); *F21S 8/026* (2013.01); *F21Y 2101/00* (2013.01); *Y10T 29/49117* (2015.01)

(58) Field of Classification Search

CPC .... F21V 23/008; F21V 23/007; F21V 23/023; F21V 23/009; F21V 23/003; F21S 8/026

USPC ..... 362/373, 362, 825

See application file for complete search history.

(56) References Cited

U.S. PATENT DOCUMENTS

| | | | | |
|---|---|---|---|---|
| 1,767,988 A | | 6/1930 | Knapp | |
| 2,835,791 A | | 5/1958 | Horwitz | |
| 3,189,788 A | | 6/1965 | Cady | |
| 3,294,977 A | | 12/1966 | Duncan | |
| 3,336,473 A | | 8/1967 | Buzan | |
| 3,628,852 A | * | 12/1971 | Snaper | F21V 7/16 359/849 |
| 3,760,179 A | | 9/1973 | Addington, Jr. | |

(Continued)

FOREIGN PATENT DOCUMENTS

| | | |
|---|---|---|
| EP | 0495273 A1 | 7/1992 |
| WO | 03019073 A1 | 3/2003 |

(Continued)

OTHER PUBLICATIONS

Installation guide for IP110-F Flush Mount Adapter, Pelco, Inc., Dec. 2008, C2238M, 8 pages.

(Continued)

*Primary Examiner* — Bryon T Gyllstrom
(74) *Attorney, Agent, or Firm* — Reising Ethington P.C.

(57) ABSTRACT

A downward illumination assembly comprising a lamp housing, a power supply module removably supported on a power supply module support surface, and an LED module carried by the lamp housing and coupled to the power supply module. The power supply module extends through an opening in the housing wall with at least a portion of the module being disposed outside the lamp housing and can be installed and removed interiorly of the lamp housing through the open lower end of the lamp housing.

23 Claims, 4 Drawing Sheets

(56) References Cited

U.S. PATENT DOCUMENTS

| | | | | |
|---|---|---|---|---|
| 3,808,499 | A | 4/1974 | Edwards | |
| 4,013,993 | A | 3/1977 | Mandel et al. | |
| 4,032,828 | A | 6/1977 | Strobl et al. | |
| 4,039,822 | A | 8/1977 | Chan et al. | |
| 4,056,757 | A | 11/1977 | Mauch et al. | |
| 4,071,749 | A | 1/1978 | Balogh | |
| 4,156,891 | A | 5/1979 | Roche | |
| 4,218,725 | A | 8/1980 | Heffner et al. | |
| 4,223,232 | A | 9/1980 | Bulat | |
| 4,234,907 | A | 11/1980 | Daniel | |
| 4,241,871 | A | 12/1980 | Newell, III et al. | |
| 4,271,621 | A | 6/1981 | Garcia et al. | |
| 4,441,143 | A | 4/1984 | Richardson, Jr. | |
| 4,504,894 | A | 3/1985 | Reibling | |
| 4,520,436 | A | 5/1985 | McNair et al. | |
| 4,587,597 | A | 5/1986 | Meyers | |
| 4,682,078 | A | 7/1987 | Pascilade | |
| 4,697,890 | A | 10/1987 | Crookston et al. | |
| 4,708,223 | A | 11/1987 | Omdorff et al. | |
| 4,727,291 | A | 2/1988 | Bavaro | |
| 4,749,908 | A | 6/1988 | Sifter | |
| 4,751,398 | A | 6/1988 | Ertz, III | |
| 4,802,065 | A | 1/1989 | Minter et al. | |
| 4,875,553 | A | 10/1989 | Smith et al. | |
| 4,885,663 | A | 12/1989 | Parker | |
| 4,890,200 | A | 12/1989 | Mandy | |
| 4,905,579 | A | 3/1990 | Dame | |
| 4,907,132 | A | 3/1990 | Parker | |
| 4,947,291 | A | 8/1990 | McDermott | |
| 4,977,818 | A | 12/1990 | Taylor et al. | |
| 5,003,432 | A | 3/1991 | Mandy | |
| 5,005,108 | A | 4/1991 | Pristash et al. | |
| 5,021,928 | A | 6/1991 | Daniel | |
| 5,025,349 | A | 6/1991 | Gow | |
| 5,123,875 | A | 6/1992 | Eubank et al. | |
| 5,145,247 | A | 9/1992 | Mandy | |
| 5,161,879 | A | 11/1992 | McDermott | |
| 5,253,152 | A | 10/1993 | Yang et al. | |
| 5,408,394 | A | 4/1995 | Mandy | |
| 5,412,542 | A | 5/1995 | Mandy | |
| 5,568,964 | A | 10/1996 | Parker et al. | |
| 5,613,751 | A | 3/1997 | Parker et al. | |
| 5,618,096 | A | 4/1997 | Parker et al. | |
| 5,661,645 | A | 8/1997 | Hochstein | |
| 5,664,872 | A * | 9/1997 | Spearman | F21V 29/02 362/294 |
| 5,739,639 | A | 4/1998 | Johnson | |
| 5,850,126 | A | 12/1998 | Kanbar | |
| 5,876,107 | A | 3/1999 | Parker et al. | |
| 5,894,686 | A | 4/1999 | Parker et al. | |
| 5,895,115 | A | 4/1999 | Parker et al. | |
| 5,921,652 | A | 7/1999 | Parker et al. | |
| 5,921,670 | A | 7/1999 | Schumacher et al. | |
| 5,966,069 | A | 10/1999 | Zmurk et al. | |
| 6,030,089 | A | 2/2000 | Parker et al. | |
| 6,079,838 | A | 6/2000 | Parker et al. | |
| 6,158,867 | A | 12/2000 | Parker et al. | |
| 6,185,356 | B1 | 2/2001 | Parker et al. | |
| 6,609,804 | B2 | 8/2003 | Nolan et al. | |
| 6,712,481 | B2 | 3/2004 | Parker et al. | |
| 6,752,505 | B2 | 6/2004 | Parker et al. | |
| 6,764,196 | B2 | 7/2004 | Bailey | |
| 6,827,456 | B2 | 12/2004 | Parker et al. | |
| 6,860,628 | B2 | 3/2005 | Robertson et al. | |
| 6,872,220 | B2 | 3/2005 | Williams et al. | |
| 6,874,925 | B2 | 4/2005 | Page et al. | |
| 6,994,457 | B2 | 2/2006 | Lee | |
| 7,066,617 | B2 | 6/2006 | Mandy et al. | |
| 7,071,625 | B2 | 7/2006 | Cheng et al. | |
| 7,077,544 | B2 | 7/2006 | Parker | |
| 7,114,829 | B2 | 10/2006 | Lai | |
| 7,114,830 | B2 | 10/2006 | Robertson et al. | |
| 7,246,926 | B2 | 7/2007 | Harwood | |
| 7,261,453 | B2 | 8/2007 | Morejon et al. | |
| 7,396,139 | B2 | 7/2008 | Savage | |
| 7,484,863 | B1 * | 2/2009 | Aubrey | F21V 13/04 362/294 |
| 7,486,033 | B2 | 2/2009 | Chen et al. | |
| 7,722,227 | B2 * | 5/2010 | Zhang | F21S 8/026 362/147 |
| 7,896,517 | B2 * | 3/2011 | Mandy | F21S 8/02 362/147 |
| 8,092,035 | B2 | 1/2012 | Mandy et al. | |
| 8,096,672 | B2 | 1/2012 | Mandy et al. | |
| 8,220,970 | B1 * | 7/2012 | Khazi | F21V 29/004 362/294 |
| 8,558,407 | B2 | 10/2013 | Mandy et al. | |
| 9,004,713 | B2 | 4/2015 | Mandy et al. | |
| 2004/0125246 | A1 | 7/2004 | Okamori et al. | |
| 2005/0190345 | A1 | 9/2005 | Dubin et al. | |
| 2006/0038192 | A1 | 2/2006 | Williams | |
| 2006/0187654 | A1 | 8/2006 | Jungel-Schmid et al. | |
| 2007/0195532 | A1 | 8/2007 | Reisenauer | |
| 2007/0242461 | A1 | 10/2007 | Reisenauer et al. | |
| 2008/0024010 | A1 | 1/2008 | Romano | |
| 2008/0084700 | A1 | 4/2008 | Van de Ven | |
| 2008/0192489 | A1 | 8/2008 | Ward | |
| 2008/0258628 | A1 | 10/2008 | Higley et al. | |
| 2008/0285271 | A1 * | 11/2008 | Roberge | F21S 8/033 362/235 |
| 2008/0296975 | A1 | 12/2008 | Shakespeare et al. | |
| 2009/0080189 | A1 * | 3/2009 | Wegner | F21S 8/02 362/235 |
| 2009/0290361 | A1 | 11/2009 | Ruud et al. | |
| 2011/0044047 | A1 | 2/2011 | Mandy et al. | |
| 2011/0216547 | A1 * | 9/2011 | Honda | F21V 29/00 362/373 |
| 2011/0222291 | A1 * | 9/2011 | Peng | F21V 15/01 362/294 |
| 2011/0299290 | A1 | 12/2011 | Mandy | |
| 2012/0140490 | A1 * | 6/2012 | Rowlette, Jr. | F21K 9/00 362/373 |
| 2012/0182744 | A1 * | 7/2012 | Santiago | F21S 8/026 362/365 |
| 2012/0187852 | A1 | 7/2012 | Mandy et al. | |
| 2013/0033872 | A1 * | 2/2013 | Randolph | F21V 29/004 362/294 |
| 2013/0201679 | A1 * | 8/2013 | Pickard | F21S 8/026 362/235 |

FOREIGN PATENT DOCUMENTS

| | | |
|---|---|---|
| WO | 2005098806 | 10/2005 |
| WO | 2006031350 A2 | 3/2006 |

OTHER PUBLICATIONS

Search Report from the Intellectual Property Office for German Application No. GB1204033.3, dated Jun. 14, 2012; 1 page.

* cited by examiner

DOWNWARD ILLUMINATION ASSEMBLY

CROSS-REFERENCES TO RELATED APPLICATIONS

This patent application claims the benefit of the filing date of U.S. Provisional Patent Application Ser. No. 61/782,052, filed Mar. 14, 2013; which is incorporated herein by reference in its entirety.

BACKGROUND

Field

This application relates generally to a downward illumination assembly for directing light downward from the ceiling area of a room such as an elevator passenger compartment.

Description of Related Art Including Information Disclosed Under 37 CFR 1.97 and 1.98 U.S. Pat. No. 7,896,517

Downward illumination assemblies present a maintenance problem when a power supply must be removed from the assembly for replacement or repair. Removal and replacement often require access to an area above the assembly and a ceiling panel upon which the assembly is mounted.

SUMMARY

A downward illumination assembly is provided for directing light downward from the ceiling area of an elevator passenger compartment. The assembly may comprise a lamp housing having a housing interior defined by a housing wall extending downwardly to an open lower end that is configured to be positioned adjacent an opening in a ceiling panel. A power supply module may be removably supported in an installed position in which at least a portion of the power supply module is disposed outside the lamp housing. A power supply module support surface may be positioned and configured to support the power supply module as the power supply module is moved between the installed position and the lamp housing interior such that the power supply module can be installed and removed interiorly of the lamp housing through the open lower end of the lamp housing. An LED module comprising an LED may be disposed within and carried by the lamp housing and coupled to the power supply.

In addition, a method is provided for removing and installing components of a downward illumination assembly that is carried by a ceiling panel in an elevator passenger compartment. The method may include gaining access to an interior of a downward illumination assembly lamp housing through an open lower end of the lamp housing, removing an LED module from the assembly by removing the LED module from an installed position within the lamp housing then lowering the LED module through the open lower end of the lamp housing, and removing a power supply module from the assembly from an installed position extending at least partially outside the housing, and doing so by passing the power supply module into the lamp housing interior and then out through the open lower end of the lamp housing. A power supply module may then be installed in the assembly by passing the power supply module into the housing interior through the open lower end of the lamp housing and then into its installed position on and extending at least partially outside the lamp housing. An LED module may be installed in the assembly by passing the LED module into the lamp housing interior through the open lower end of the lamp housing and then into its installed position.

A method is also provided for removing and installing a power supply module of a downward illumination assembly that is carried by a ceiling panel. The method may include the steps of gaining access to an interior of a downward illumination assembly lamp housing through an open lower end of the lamp housing, removing a power supply module from the assembly from an installed position extending at least partially outside the housing, and doing so by passing the power supply module into the lamp housing interior and then out through the open lower end of the lamp housing, and installing a power supply module in the assembly by passing the power supply module into the housing interior through the open lower end of the lamp housing and then into its installed position on and extending at least partially outside the lamp housing.

DRAWING DESCRIPTIONS

These and other features and advantages will become apparent to those skilled in the art in connection with the following detailed description and drawings of one or more embodiments of the invention, in which.

Figure 1:
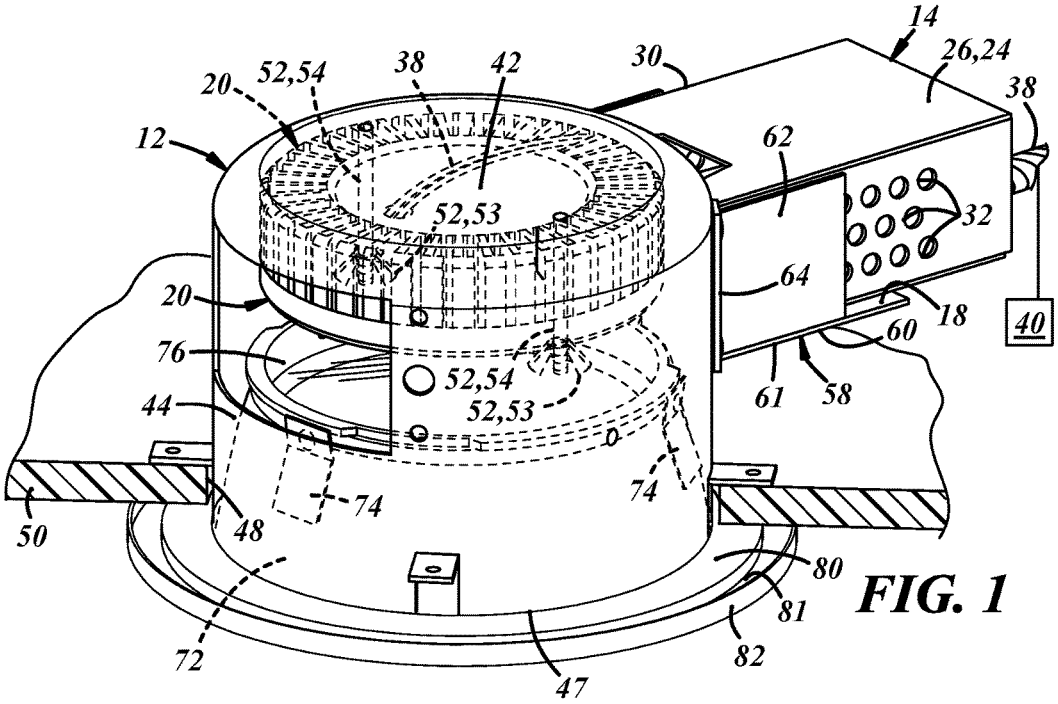
FIG. 1 is a perspective view of a downward illumination assembly in an assembled state and mounted on a ceiling panel in an elevator.
Figure 4:
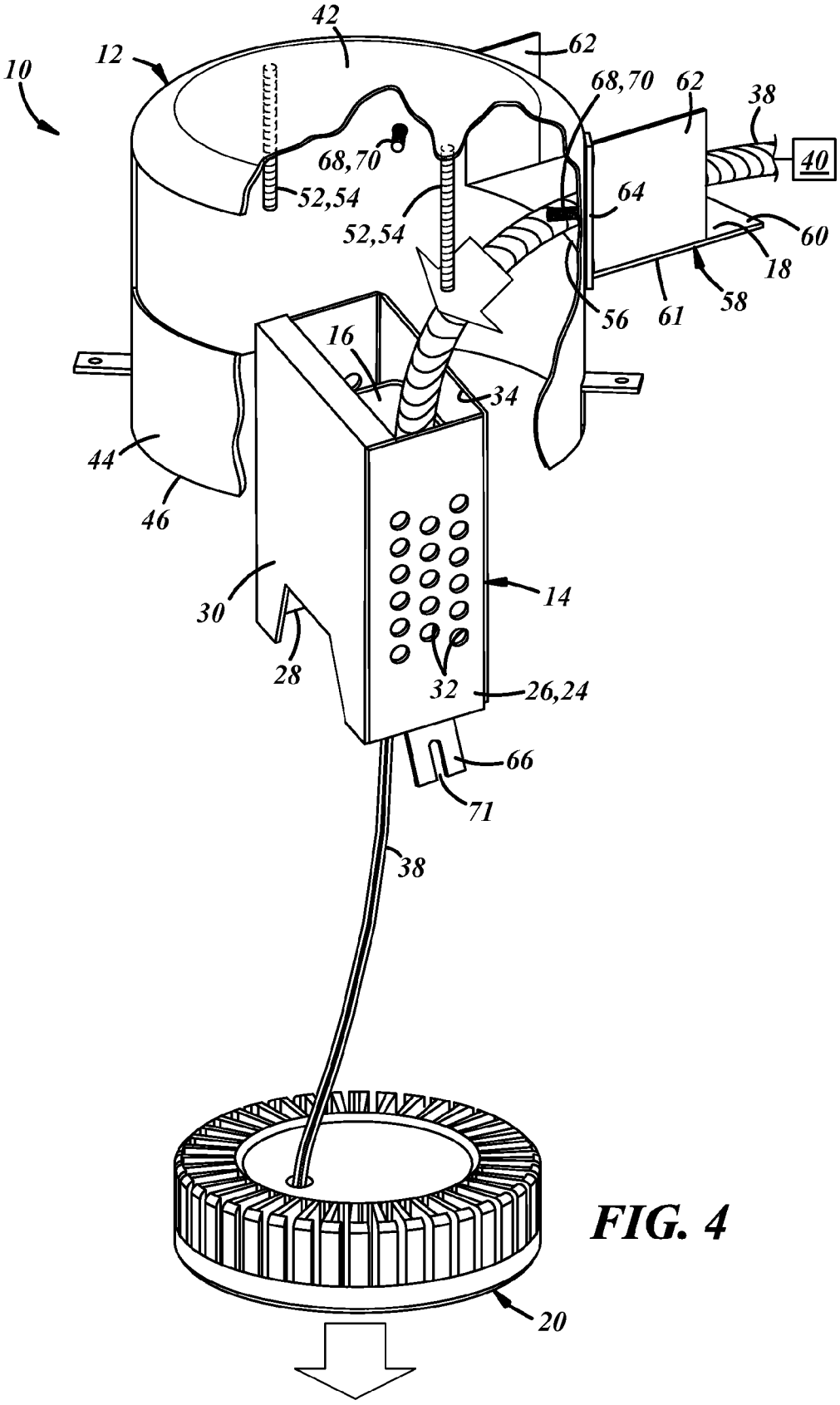
Figure 5:
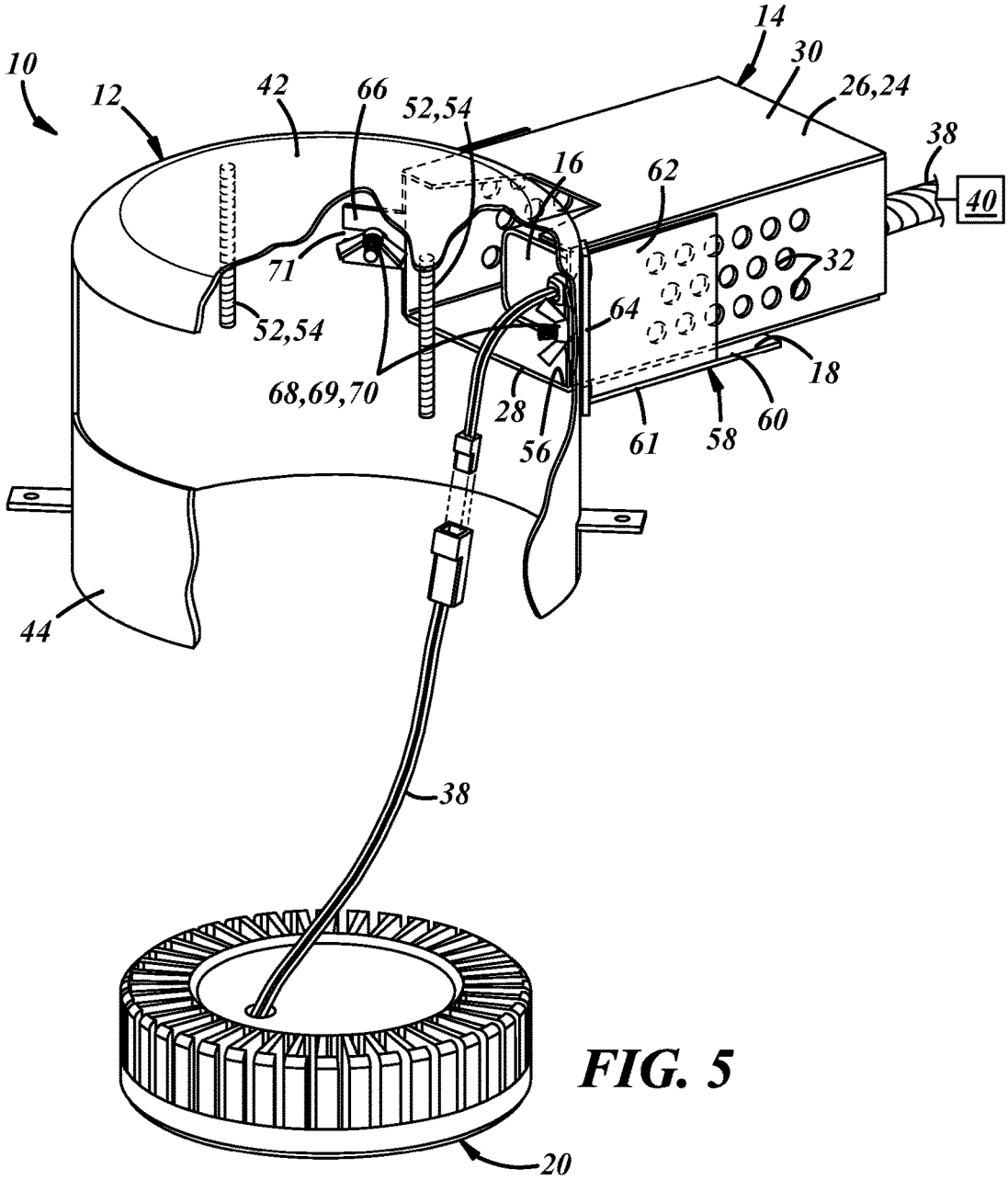

FIG. 4 is a partially cut-away perspective view of the assembly of FIG. 1 with the power supply having been removed downwardly through the lower opening of the lamp housing of the assembly and with a back wall of the power supply cut away to reveal an LED driver of the power supply; and FIG. 5 is a partially cut-away perspective view of the assembly of FIG. 1 with the lamp module having been removed downwardly through the lower opening of the lamp housing, and electrically disconnected from the power supply.

DETAILED DESCRIPTION

A downward illumination assembly for directing light downward from the ceiling area of a room, such as an elevator passenger compartment, is generally shown at 10 in FIGS. 1-5. The assembly 10 may include a lamp housing 12, a power supply module 14 comprising an LED driver 16, a power supply module support surface 18, and an LED module 20 comprising an LED and carried by the lamp housing 12. The LED module 20 may be electrically coupled to the power supply module 14.

The power supply module 14 may be removably supported in an installed position in which at least a portion of the power supply module 14 is disposed outside the lamp housing 12. The power supply module 14 may include a power supply module enclosure 24 including a box portion 26 having a box opening 28 and a cover panel 30 removably securable to close a top portion of the box portion 26. The power supply module enclosure 24 may also include ventilation holes 32.

As best shown in FIG. 4, the power supply module enclosure 24 may include an electrical power port 34 that may be disposed in a radially outer one of two end panels (not shown) of the power supply module enclosure 24. A current path 38 may extend from the LED module 20 through the power supply module 14 and the electrical power port 34 and may be connectable to an electrical power source 40. In other words, the current path 38 may complete an electrical power circuit comprising the LED module 20, the power supply module 14, and the electrical power source 40.

As best shown in FIG. 1, the lamp housing 12 may have a closed upper end 42, and a housing interior defined by a housing wall 44 extending downwardly to an open lower end 46 from around a periphery of the closed upper end 42. The open lower end 46 of the lamp housing 12 may be configured to be positioned adjacent an opening 48 in a ceiling panel 50. The closed housing upper end 42 may be generally circular in shape, and the housing wall 44 may be generally cylindrical in shape. The upper end and wall of the lamp housing 12 may define, or give the housing 12 the shape of, a downwardly opening canister.

Figure 3:
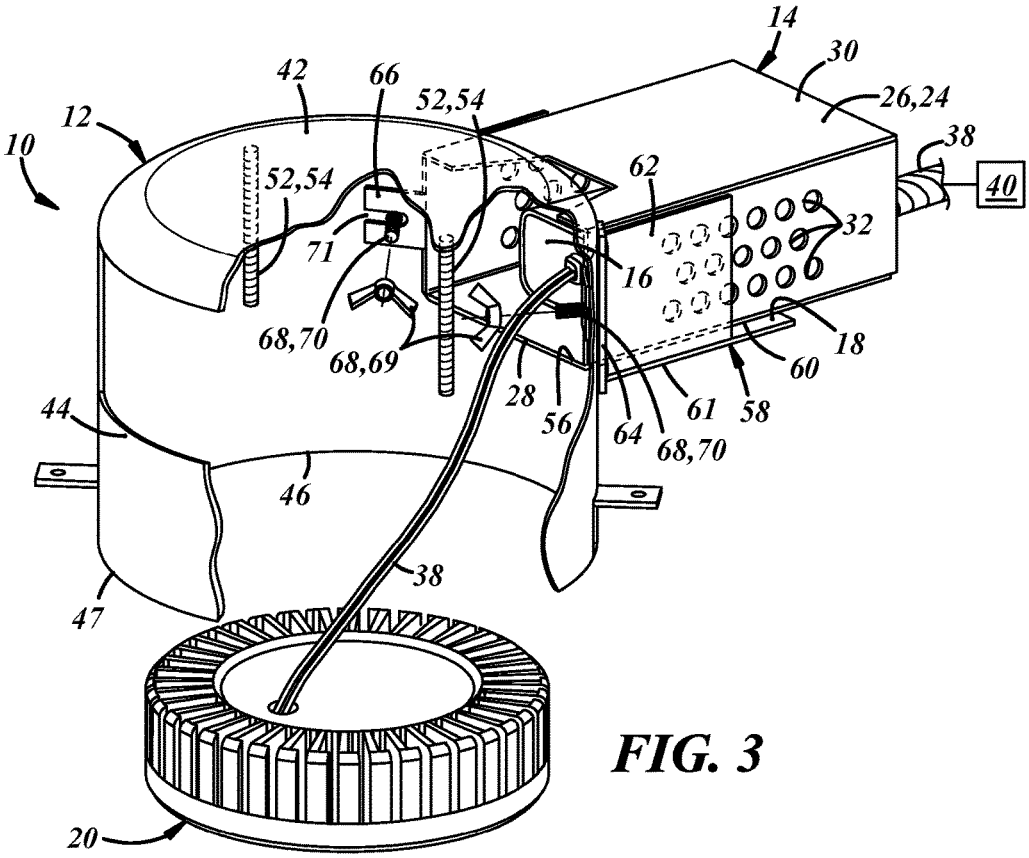
FIG. 3 is a perspective view of the assembly of FIG. 1 with a lamp module of the assembly having been removed downwardly through a lower opening of a lamp housing of the assembly, but remaining connected by electrical wiring to a power supply of the assembly.

The LED module 20 may be removably fastened to the closed upper end 42 of the lamp housing 12 by two LED module fasteners 52 as best shown in FIGS. 1 and 3. Each LED module fastener 52 may include a threaded mounting post 54 carried by and extending axially downward from the closed upper end 42 of the lamp housing 12, and the LED module 20 may include two openings 56 configured and positioned to receive the respective mounting posts 54. Each LED module fastener 52 may further include a nut 53, such as, for example, a wing nut that is configured to thread onto one of the mounting posts 54 and secure the LED module 20 in its installed position. The nuts 53 may also be configured to unthread from the mounting posts 54 to free the LED module 20 for removal.

The lamp housing 12 may also include a power supply module receptacle opening 56 formed in the housing wall 44. The power supply module receptacle opening 56 may be spaced from the open lower end 46 of the housing 12, and the opening 56 may be shaped, and may be large enough, to allow the power supply module 14 to pass completely through between the installed position and the housing interior. The opening 56 may be configured to allow the power supply module 14 to be removed interiorly of the lamp housing 12 by drawing the power supply module 14 into the lamp housing 12 through the opening 56 into a position from which the power supply module 14 may then be removed through the open lower end 46 of the lamp housing 12.

As best shown in FIG. 4, the assembly 10 may include a side-mounted power supply module receptacle tray 58 carried by the housing wall 44 in alignment with the power supply module receptacle opening 56. The power supply module receptacle tray 58 may include a floor panel 60 and two side panels 62 extending integrally upward from along opposite side edges 61 of the floor panel 60. The two side panels 62 may be spaced to receive the power supply module 14 as it is moved from a position within the lamp housing 12 to the installed position between the side panels 62 on the receptacle tray 58, and to allow the power supply module 14 to be removed from the installed position on the receptacle tray 58 to a position within the lamp housing 12. The power supply module enclosure cover 30 may also be configured to be fastened to the power supply module enclosure box portion 26 without impeding sliding motion of the power supply module 14 along the power supply module receptacle tray 58.

The receptacle tray 58 may also include the power supply module support surface 18. The power supply module support surface 18 may be positioned and configured to support the power supply module 14 as the power supply module 14 is moved between the installed position and the lamp housing interior so that the power supply module 14 can be installed and removed interiorly of the lamp housing 12 through the open lower end 46 of the lamp housing 12. The power supply module 14 may be removably supported on the power supply module receptacle tray 58 such that an LED module 20 may fit within the lamp housing 12 when the power supply module 14 is in the installed position.

The power supply module receptacle tray 58 may include tray mounting tabs 64 extending circumferentially outwardly from the side panels 62 of the tray 58. The tray mounting tabs 64 may be fastened to the housing wall 44. An inner end of the power supply module 14 may include power supply module mounting tabs 66 (best shown in FIG. 4) positioned to engage the lamp housing wall 44 adjacent the power supply module receptacle opening 56. The power supply module mounting tabs 66 may be positioned to engage power supply module fasteners 68 mounted on an inner surface of the lamp housing wall 44 adjacent the power supply module receptacle opening 56.

Figure 2:
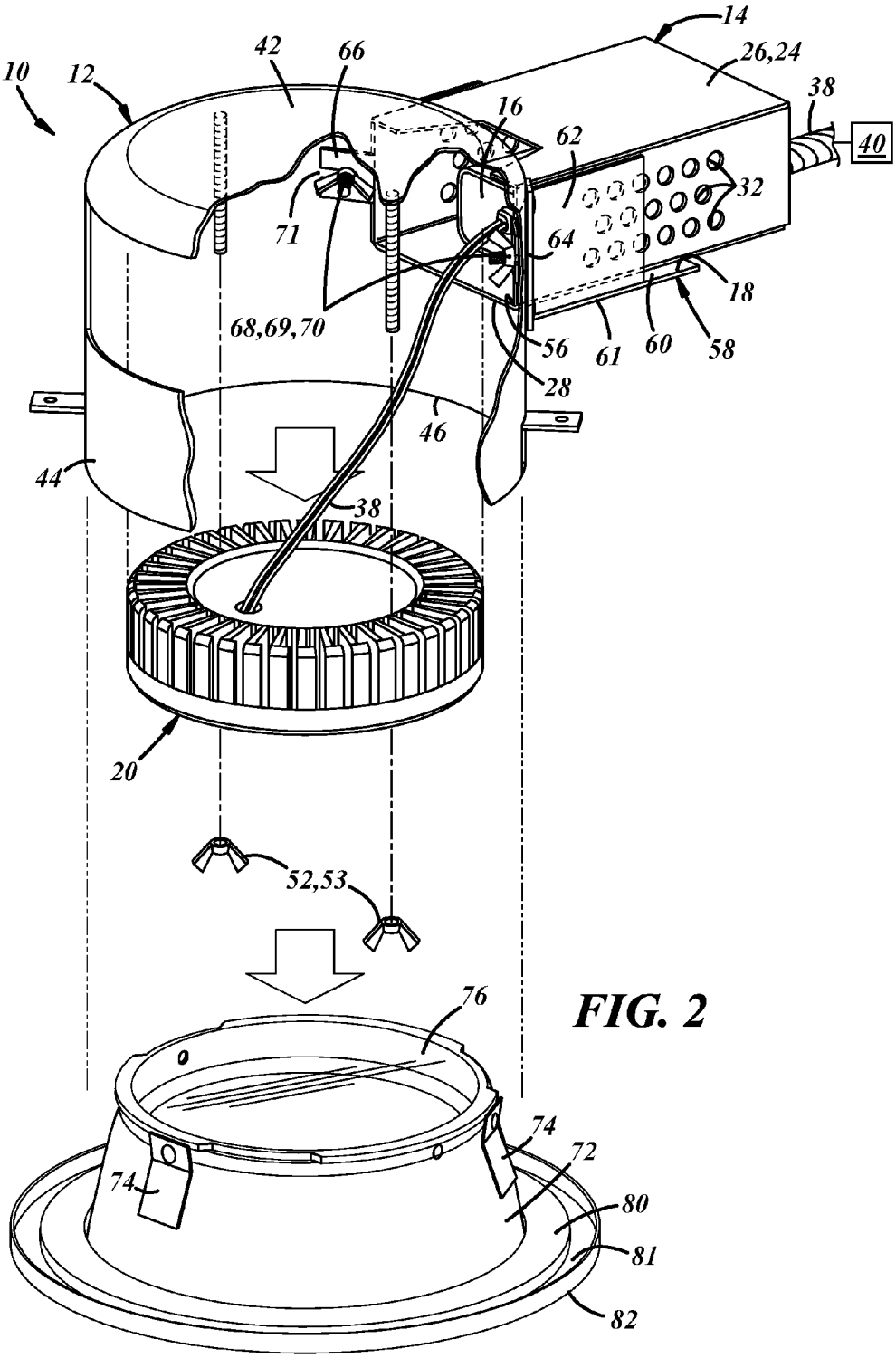
FIG. 2 is a perspective exploded view of the assembly of FIG. 1.

As best shown in FIGS. 2 and 3, each power supply module fastener 68 may include a threaded mounting post 70 carried by and extending radially inward from the lamp housing wall 44, and each power supply mounting tab 66 may include an opening 71 configured to receive a threaded post 70. Each power supply module fastener 68 may further include a nut 69, such as, for example, a wing nut, that is configured to thread onto the post 70 and secure a mounting tab 66 to the lamp housing wall 44, thus securing the power supply module 14 in the installed position. The nuts 69 may also be configured to unthread from the mounting posts 70 to free the power supply module 14 for removal.

As best shown in FIGS. 1 and 2, an annular trim bezel 72 may be removably received in the lamp housing 12 in a position spanning an annular gap between an inner circumferential surface 45 of the lamp housing wall 44 and an outer circumferential surface 21 of the LED module 20. This blocks the power supply module 14, power supply module fasteners 68, and all evidence of the inward removability of the power supply module 14, from the view of an occupant of the elevator passenger compartment, below. The trim bezel 72 must be removed to view and to access and remove the power supply module fasteners 68 and to remove the power supply module 14. The trim bezel 72 may be removably held in place within the lamp housing 12 by spring clips 74. The trim bezel 72 may carry a lens 76 across an upper opening 78 of the bezel, and may include an annular pad 80 within a circumferential trough 81 formed into a lower annular flange 82 of the bezel 72. The annular pad 80 is positioned to engage a lower rim 47 of the lamp housing 12 when the trim bezel 72 is installed.

The power supply module 14 of the downward illumination assembly 10 may be removed by first removing the trim bezel 72 from the lamp housing 12 to gain access to the interior of the lamp housing 12 as shown in FIG. 2. The LED module 20 may then be removed from its installed position within the lamp housing 12 by first unscrewing the LED module fasteners 52 from the LED module mounting posts 54 and then lowering the LED module 20 through the open lower end 46 of the lamp housing 12 as shown in FIG. 4. The power supply module 14 may then be removed from its installed position on the power supply module receptacle tray 58 by disengaging the power supply module fasteners 68 releasably fastening the power supply module mounting tabs 66 to the lamp housing wall 44, i.e., by unscrewing the wing nuts 69 from the threaded power supply module mounting posts 70. The power supply module 14 may then be passed into the lamp housing interior and then out through the open lower end 46 of the lamp housing 12.

A power supply module 14 may be installed in the assembly 10 by passing the power supply module 14 into the housing interior through the open lower end 46 of the lamp housing 12 and then into its installed position on and extending at least partially outside the lamp housing 12, then releasably fastening the power supply module 14 to the housing wall 44 by engaging a power supply module fastener 68.

A downward illumination assembly constructed as described above allows easy removal for repair of replacement of bulky parts of the assembly without any need to access the assembly from above, despite the fact that the assembly extends well beyond the radius of the exposed lower end of its housing.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

The invention claimed is:

1. A downward illumination assembly for directing light downward from the ceiling area of an elevator passenger compartment, the assembly comprising:

a lamp housing having a housing interior defined by a housing wall extending downwardly to an open lower end that is configured to be positioned adjacent an opening in a ceiling panel;

a power supply module removably supported in an installed position in which at least a portion of the power supply module is disposed outside the lamp housing;

a power supply module support surface carried by the lamp housing and supporting the power supply module in the installed position and as the power supply module is moved between the installed position and the lamp housing interior such that the power supply module can be installed and removed interiorly of the lamp housing through the open lower end of the lamp housing; and an LED module comprising an LED and disposed within and carried by the lamp housing in an installed position spaced from and electrically coupled to the power supply.

2. A downward illumination assembly as defined in claim 1 in which:

the housing includes a closed upper end;

the housing wall extends downwardly to the open lower end from around a periphery of the closed upper end; and the LED module is removably fastened to the closed upper end in an installed position and is installable and removable interiorly of the lamp housing through the open lower end of the lamp housing.

3. A downward illumination assembly as defined in claim 2 in which:

the LED module is removably fastened to the closed upper end of the lamp housing by at least one module fastener comprising a threaded mounting post carried by and extending downward from the closed upper end of the lamp housing;

the LED module includes an opening configured and positioned to receive the mounting post when the LED module is in its installed position; and each LED module fastener further includes a nut configured to thread onto one of the mounting posts and removably secure the LED module in its installed position.

4. A downward illumination assembly as defined in claim 1 in which:

the upper end and wall of the lamp housing define a downwardly opening canister; and the housing wall includes a power supply module receptacle opening spaced from the open lower end and configured to allow the power supply module to be removed interiorly of the lamp housing by drawing the power supply module into the lamp housing through the aperture into a position from which the power supply module may then be removed through the open lower end of the lamp housing.

5. A downward illumination assembly as defined in claim 4 in which the housing wall includes a power supply module receptacle opening large enough to allow the power supply module to pass completely through the power supply module receptacle opening.

6. A downward illumination assembly as defined in claim 1 in which a sufficient portion of the power supply module is disposed exteriorly of the lamp housing in its installed position to allow room for the LED module to be removable and installable interiorly of the lamp housing with the power supply module in its installed position.

7. A downward illumination assembly as defined in claim 6 in which:

the assembly includes a side-mounted power supply module receptacle tray carried by the housing wall in alignment with the power supply module receptacle opening and including the power supply module support surface, and the power supply module, in its installed position, is removably supported on the power supply module receptacle tray in a position allowing room for the LED module to be installed within the lamp housing.

8. A downward illumination assembly as defined in claim 7 in which:

the power supply module receptacle tray includes a floor panel and two side panels extending integrally upward from along opposite side edges of the floor panel; and the two side panels are spaced to receive the power supply module into the installed position between the side panels on the receptacle tray from a position within the lamp housing and to allow the power supply module to be moved from the installed position on the receptacle tray to a position within the lamp housing.

9. A downward illumination assembly as defined in claim 8 in which the power supply module receptacle tray includes at least one tray mounting tab extending circumferentially outwardly from at least one of the side panels of the tray, the tray mounting tab being fastened to the housing wall.

10. A downward illumination assembly as defined in claim 1 in which an inner end of the power supply module includes at least one power supply module mounting tab positioned to engage the lamp housing wall adjacent the power supply module receptacle opening.

11. A downward illumination assembly as defined in claim 10 in which the power supply module mounting tab is positioned to engage a power supply module fastener mounted on an inner surface of the lamp housing wall adjacent the power supply module receptacle opening.

12. A downward illumination assembly as defined in claim 11 in which:

the power supply module fastener includes a threaded post;

the mounting tab includes an opening configured to receive the threaded post; and the power supply module fastener further includes a nut configured to thread onto the post and secure the mounting tab to the lamp housing wall and to unthread from the posts to free the power supply module for removal.

13. A downward illumination assembly as defined in claim 12 in which the nut configured to thread onto the post and secure the mounting tab to the lamp housing wall and to unthread from the posts to free the power supply module for removal, is a wing-nut.

14. A downward illumination assembly as defined in claim 1 in which the power supply module includes a power supply module enclosure including a box portion having a box opening and a cover panel removably securable over to the box portion over the box opening, the power supply module enclosure cover being configured to be fastened to the power supply module enclosure box portion without impeding sliding motion of the power supply module along the power supply module receptacle tray.

15. A downward illumination assembly as defined in claim 14 in which:

the power supply module enclosure includes an electrical power port disposed in the power supply module enclosure; and at least one current path extends from the LED module through the power supply module and the electrical power port and is connectable to an electrical power source.

16. A downward illumination assembly as defined in claim 14 in which a nut is configured to thread onto one of the mounting posts and removably secure the LED module to a wing-nut.

17. A downward illumination assembly as defined in claim 1 and further including a trim bezel shaped and supported in a position blocking the view of elevator passenger compartment occupants through a gap between an inner surface of the lamp housing wall and an outer surface of the LED module.

18. A downward illumination assembly as defined in claim 17 in which:

the lamp housing upper end and the lamp housing wall define a downwardly opening canister;

the gap defined between the inner surface of the lamp housing wall and outer surface of the LED module is annular in horizontal cross-section; and the trim bezel is shaped and supported in a position to block the view of elevator passenger compartment occupants through the gap while permitting light from the LED to pass from the lamp housing into the passenger compartment.

19. A downward illumination assembly as defined in claim 18 in which the trim bezel is carried by the lamp housing, has a generally annular shape, and is configured to span the gap between the inner surface of the lamp housing wall and outer surface of the LED module.

20. A method for removing and installing components of a downward illumination assembly that is carried by a ceiling panel in an elevator passenger compartment, the method including the steps of:

gaining access to an interior of a downward illumination assembly lamp housing through an open lower end of the lamp housing;

removing an LED module from the assembly by unfastening the LED module from the lamp housing, removing the LED module from an installed position within the lamp housing, then lowering the LED module through the open lower end of the lamp housing;

after removing the LED module, removing a power supply module from an installed position extending at least partially outside the housing, and doing so by passing the power supply module into the lamp housing interior and then out through the open lower end of the lamp housing;

installing a power supply module in the assembly by passing the power supply module into the housing interior through the open lower end of the lamp housing and then into its installed position on and extending at least partially outside the lamp housing; and after installing the power supply module, installing an LED module in the assembly by passing the LED module into the lamp housing interior through the open lower end of the lamp housing and into its installed position, then fastening the LED module to the lamp housing.

21. The method of claim 20 in which:

the method includes the additional step of providing a trim bezel in a position spanning a gap between an inner surface of the lamp housing wall and an outer surface of the LED module after the steps of installing a power supply and installing an LED module; and the step of gaining access to the housing interior through the open lower end of the lamp housing includes removing the trim bezel from the assembly.

22. The method of claim 20 in which:

at least one of the removing steps includes unscrewing a nut that is releasably fastening at least one of the power supply module and LED module to the lamp housing; and at least one of the installing steps includes screwing a nut into a position releasably fastening at least one of the power supply module and LED module to the housing.

23. The method of claim 22 in which the step of screwing a nut into a position releasably fastening at least one of the power supply module and LED module to the housing includes screw a wing-nut into such a position.

* * * * *